US005837975A

United States Patent [19]

Dillard et al.

[11] Patent Number: 5,837,975

[45] Date of Patent: Nov. 17, 1998

[54] CORRUGATED STRIP, RADIANT HEATER ELEMENT

[75] Inventors: Richard J. Dillard, Vernon; William W. Holmes, Decatur, both of Ala.

[73] Assignee: Emerson Electric Co., St. Louis, Mo.

[21] Appl. No.: 681,861

[22] Filed: Jul. 29, 1996

[51] Int. Cl.[6] ..... H05B 3/68

[52] U.S. Cl. ..... 219/456; 219/467

[58] Field of Search ..... 219/455, 456, 219/458, 463, 464, 465, 467, 449; 338/278, 279, 280

[56] References Cited

U.S. PATENT DOCUMENTS

| | | | |
|---|---|---|---|
| 3,567,906 | 3/1971 | Hurko | 219/464 |
| 3,612,828 | 10/1971 | Siegla | 219/464 |
| 3,612,829 | 10/1971 | Evans | 219/464 |
| 4,034,206 | 7/1977 | Penrod | 219/464 |
| 4,161,648 | 7/1979 | Goessler | 219/464 |
| 4,237,368 | 12/1980 | Welch | 219/464 |
| 4,508,961 | 4/1985 | McWilliams | 219/464 |
| 4,551,616 | 11/1985 | Buttery | 219/464 |
| 4,900,899 | 2/1990 | Schreder et al. | 219/464 |
| 5,477,031 | 12/1995 | McWilliams | 219/467 |
| 5,498,853 | 3/1996 | Gross et al. | 219/463 |

*Primary Examiner*—Teresa J. Walberg
*Assistant Examiner*—Sam Paik
*Attorney, Agent, or Firm*—Polster, Lieder, Woodruff & Lucchesi

[57] ABSTRACT

Radiant heating apparatus (10) for use on a stove (1). The heating apparatus is mounted beneath a glasstop type cooking surface (2) for radiating heat at the surface to heat the surface for cooking food. A pan (14) is installed adjacent an underside (2*u*) of the cooking surface. A liner (30) formed of an insulation material is installed in the pan. An electrical heating element (32) is supported atop the liner. The heating element is formed of a strip (34) of an electrically resistant foil material to which an electrical current is supplied. The strip is a corrugated strip of foil laid upon an upper surface (36) of the liner in a predetermined pattern for heat generated by the heating element to be radiated directly at the cooking surface. A staple (42) secures the heating element to the liner. A temperature sensitive element (48) controls current flow to the heating element, and cuts-off current flow if the temperature exceeds a predetermined level. Installation of a corrugated strip heating element on the liner and securing the heating element such that it can flex when a current is supplied to it, without permanently distorting the strip, effects a maximum heat transfer to the cooking surface using energy directly radiated from the heating element.

11 Claims, 4 Drawing Sheets

CORRUGATED STRIP, RADIANT HEATER ELEMENT

BACKGROUND OF THE INVENTION

This invention relates to radiant glasstop heating units of the type used on ranges or stoves and, more particularly, to a heater element for use in such units employing a corrugated strip heating element.

Radiant heating units used on ranges or stoves for cooking food in pots, pans or other cooking utensils are well-known in the art. The heating unit is an electrical unit and includes a support pan mounted beneath a glass top which covers the cooking surface of the stove. The pan is usually lined with an insulation material. A heating element is installed atop this liner and is connected in an electrical circuit for a current to flow through the unit when the unit is turned on. The resulting heat is directed upwardly unto the underside of the cook top to heat a defined area on which cooking utensils are set.

The heating element used in these units is typically an electrical resistance material which is an unsheathed, bare strip set upon the insulation in a predetermined pattern. In assembling a cooking unit, the strip of material is first cut to an appropriate length to obtain the resistance required for the wattage produced by the unit when a rated voltage is applied to the heating element. The element is mounted on the top surface of the liner in the predetermined pattern, this being done using an appropriate installation fixture. The element is installed so that it is "on edge", that is, perpendicular with respect to the top surface of the liner on which it is installed. Once installed, the edge of the resistance strip is pressed or driven into the liner, and the ends of the strip are terminated in a thermal limiter which controls current flow to the strip. The limiter is temperature sensitive and disrupts current flow if the unit temperature exceeds a preset limit.

A problem with conventional heating units is that they typically employ a coiled heating element which is an unsheathed strip. The diameter of the coil is such that the displacement between the coil and the cooking surface is relatively large. This, in turn, requires installation of the heating unit some distance beneath the cooking surface. Use of a thin strip-type heating element can reduce the thickness of the heating element, reduce the distance between the heating element and cooking surface, and make for a more compact heating unit. Also, if the strip is mounted on edge, radiation emanating from the flat surfaces of the strip tends to radiate parallel to the liner. This results in the energy striking the underside of the glass top being reflected or scattered. As such, this construction makes for an inefficient energy transfer between the heating element and cooking surface. Strip-type heating elements have been previously used. Examples of such usage are shown, for example, in U.S. Pat. Nos. 5,453,597, 5,393,958, 5,369,874, and 4,161,648.

An additional concern with previous heater constructions of this type is thermal expansion and contraction of the heating element during cycling of the unit "on" and "off". After repeated heating and cooling cycles, the element tends to work itself free from the insulating material into which it is pressed. The resultant distortion effects the efficiency of heat transfer to the cooking surface. And, if a loosened section of the heating element comes into contact with another section of the element, an electrical short will occur rendering the unit inoperative.

SUMMARY OF THE INVENTION

Among the several objects of the present invention may be noted the provision of a radiant heating unit for use in cooking tops for stoves; the provision of such a heating unit to be mounted beneath the cooking top, closely adjacent to the underside of the cooking top to radiate heat at a defined area of the cooking top representing a cooking surface for heating food; the provision of such a heating unit to employ a corrugated strip radiant heating element; the provision of such a heating element to be substantially thinner than conventional sheathed strip heating elements, this allowing a heating unit to be positioned closer to the cooking surface than conventional heating units using sheathed resistance strip; the provision of such a heating unit which therefore facilitates a more compact heating unit assembly; the provision of such a heating element to be arranged in one of a number of defined patterns to efficiently radiate heat toward the cooking surface; the provision of such a heating element to be mounted on a liner of the heating unit and to be secured to the liner in such a way as to flex during operating cycles, but to be sufficiently restrained so as to not work itself loose and cause an electrical short which would require replacement of the unit; the provision of such a heating element to employ tabs or the like integrally formed with the heating element to secure the heating element to the liner; the provision of such a heating element in which usage of a heating element having tabs or a similar means for securing the heating element to the liner provides an area of increased resistance in the heating element; the provision of such heating element construction to advantageously route the majority of current flow through the portion of the heating element extending above the liner to thereby provide more efficient heating by the heating element; the provision of such a heating element to radiate heat directly at the cooking surface rather than to heat the surface indirectly by the heat being scattered or reflected onto the cooking surface; and, the provision of such a heating element which is readily usable in existing heating units to provide an efficient, compact, reliable, relatively low cost heating source for heating the cooking surface.

In accordance with the invention, generally stated, a radiant heating unit is for use on a stove. The heating unit is mounted beneath a glasstop type cooking surface for radiating heat at the surface to heat the surface for cooking food thereon. A pan is installed adjacent an underside of the cooking surface. A liner formed of an insulation material is installed in the pan. An electrical heating element is supported atop the liner. The heating element is formed of a strip of an electrically resistant foil material to which an electrical current is supplied. The strip is a corrugation of material laid upon an upper surface of the liner in a predetermined pattern for heat generated by the heating element to be radiated directly at the cooking surface. In one embodiment, a number of staples secure the heating element to the liner. In an alternative embodiment, the heating element has integrally formed tabs or the like to install the heating element, while providing an element which efficiently generates heat. A temperature sensitive element controls current flow to the heating element, and cuts-off current flow if the temperature exceeds a predetermined level. Installation of a corrugated strip heating element on the liner and securing the heating element such that it can flex when a current is supplied to it, without being permanently distorted, effects a maximum heat transfer to the cooking surface using energy directly radiated from the heating element. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
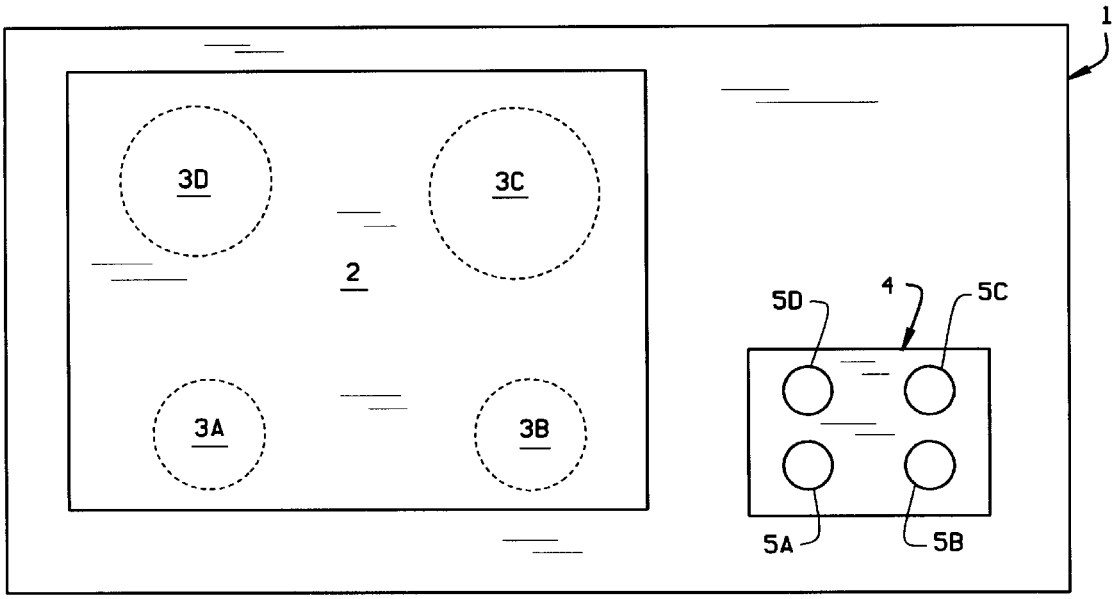
FIG. 1 is a top plan view of a stove having heating units of the present invention mounted below a glasstop cooking surface of the stove.
Figure 2A:
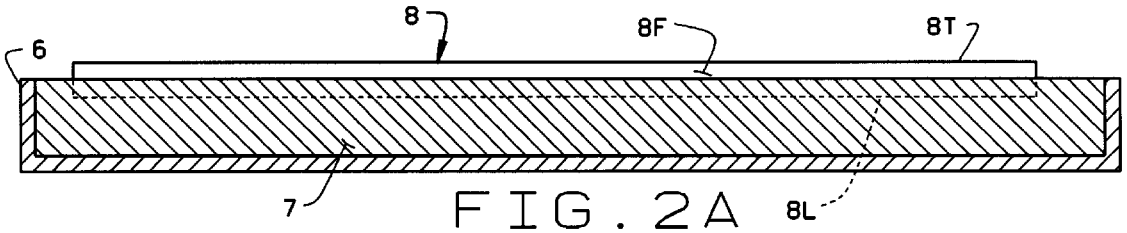
FIG. 2A PRIOR ART
FIG. 2A is a side elevational view of a prior art heating element installation in a heating unit.
Figure 2B:
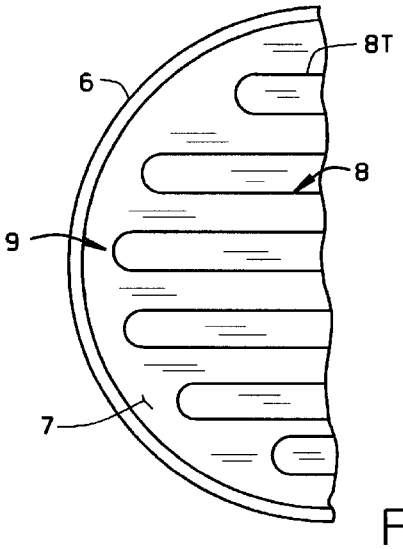
FIG. 2B PRIOR ART
FIG. 2B is a partial plan view of the prior art installation.
Figure 6:
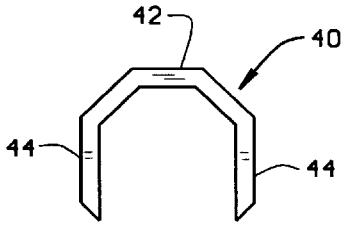
FIG. 6 is an elevational view of a staple used to affix the heating element in place on the heating unit.

Referring to the drawings, an electric range is indicated generally 1 in FIG. 1. The range has a cook top 2 on which various types of cooking utensils are placed for cooking food placed in the utensils. The cook top is a glasstop type cooking surface having a ceramic/glass construction. Cook top 2 has defined cooking areas, four of which 3A–3D are shown in FIG. 1. As seen therein, all the cooking areas are not of the same size. This allows different size utensils to be placed on the most appropriate area to allow for efficient cooking of the food. A control panel 4 has a control knob 5A–5D respectively, for separately controlling the temperature of each cooking area. The cooking areas are warmed using radiant heat directed at the cooking surface from below. A prior art heating unit for accomplishing this is shown in FIGS. 2A and 2B. A pan 6 is mounted below each defined cooking area of the cooking top. The pan has an insulating material 7 placed in it. A heating element 8, which is an electrical resistance heating element comprises a strip heating element. The heating element is set edgewise upon the insulating material in a pattern 9 as generally indicated in FIG. 2B. After being set in place, the lower edge 8L of the heating element is pressed into the liner as indicated in FIG. 2A. Thereafter, as current is supplied to the element, the element radiates heat which is directed at the underside 2*u* of cooking top 2 to heat the particular cooking area.

There are two problems with this heating unit construction. One is that a substantial portion of the heat radiated by the element is not directly radiated onto the underside of the cooking top. This is because the surface area of the top edge 8T of the element, from which heat is directly radiated at the cooking surface, is quite small in comparison with the front face 8F of the element. The heat generated from the front face actually radiates parallel to the surface to be heated, and this radiated energy reaches the surface by being reflected off of adjoining reaches of the element, or the sides of the pan 6 onto the cooking surface. This decreases the efficiency of the heating unit.

In addition, whenever current is applied to the heating element, the heating element expands as it heats up. The amount of this expansion is limited by clips (not shown) or other means of attachment by which ends and intermediate portions of the heating element are attached to the pan liner. Similarly, when current is removed and the element cools, it tends to return to its initial shape. Over time, the repeated expansions and contractions of the heating element warp it into a distorted configuration which tends to further lessen the efficiency of the heater. Also, as the heating element loosens due to the repeated flexing, it may eventually wriggle out of the slot or indentation formed by the edge of the strip being driven into the liner and coming into contact with other portions of the heating element, thereby creating an electrical short. When this occurs, the heating unit must be replaced which is an expense to the user.

Referring to FIGS. 3–7, apparatus of the present invention comprises a heating unit indicated generally 10 which is an improvement over the prior art heating equipment disclosed in FIGS. 2A and 2B. Apparatus 10, when used on stove 1 to produce heat for food, radiates sufficient heat toward a defined cooking area heated by the radiant energy so to quickly and efficiently elevate the area temperature to a level sufficient to cook any food in a utensil placed on the stove. Apparatus 10 first includes a pan means 12 installed adjacent an underside of the cooking surface. In FIG. 5A, pan means 12 is shown to include an octagonal shaped (in plan), shallow pan 14 having a base 16, and an upturned circumferential flange forming a sidewall 18 of the pan. The sidewall of the pan is approximately 0.717" (1.8 cm.) high and angles inwardly from the base to the upper end of the pan's sidewall 14. The pan further includes a tab means 20 extending from base 16. In FIG. 5B, the tab means is shown to include at least one tab 22 located at the center of the pan base and projecting downwardly from the base. A second tab 22 (not shown) may also be employed. A support plate or mounting plate 24 fits beneath the cook top, and is sized to cover an area large enough that the cooking unit for each of the cooking areas can be attached to the plate. The plate has a slot 26 through which the mounting tab fits. A spring 27 fits over the mounting tab(s) 22 and provides a spring compression force for the heating unit to urge it against the underside of the glasstop.

An optional construction consists of a circular drawn pan similar to pan 6 shown in FIGS. 2A and 2B. This optional construction pan has sidewalls which are approximately 1.100" (2.8 cm.) high. The pan houses insulation material as well as the resistance element. A ring of approximately 0.125" (0.32 cm.) of the insulation material protrudes above the rim of the pan. The upper edge or face of this material provides a seal between the glass top and the heater element assembly.

Figure 3:
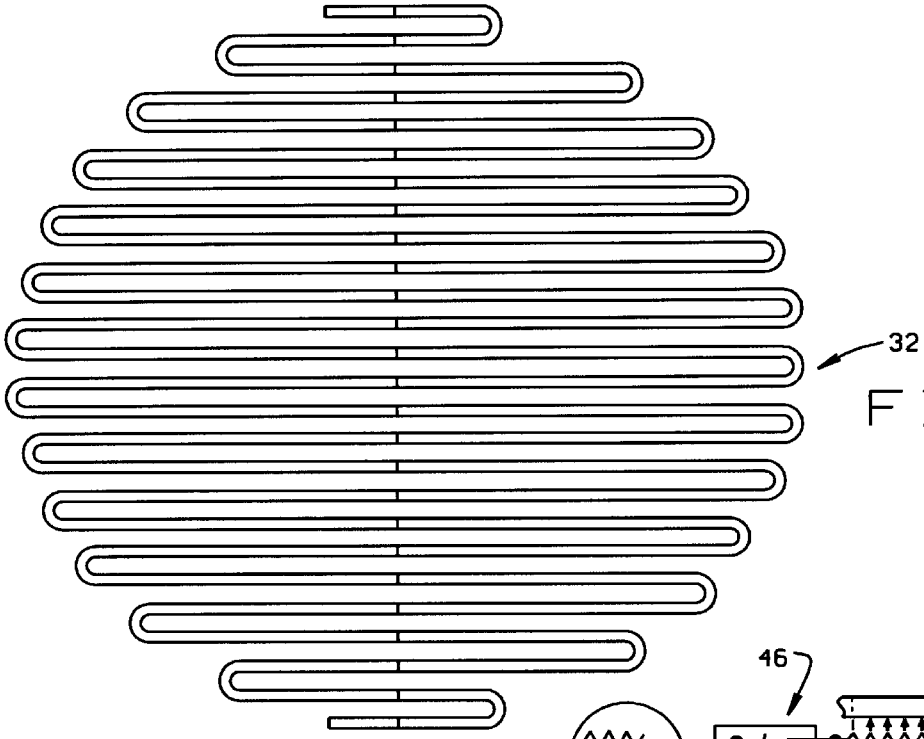
FIG. 3 is a plan view of a foil type ribbon or strip radiant heating element.
Figure 4B:
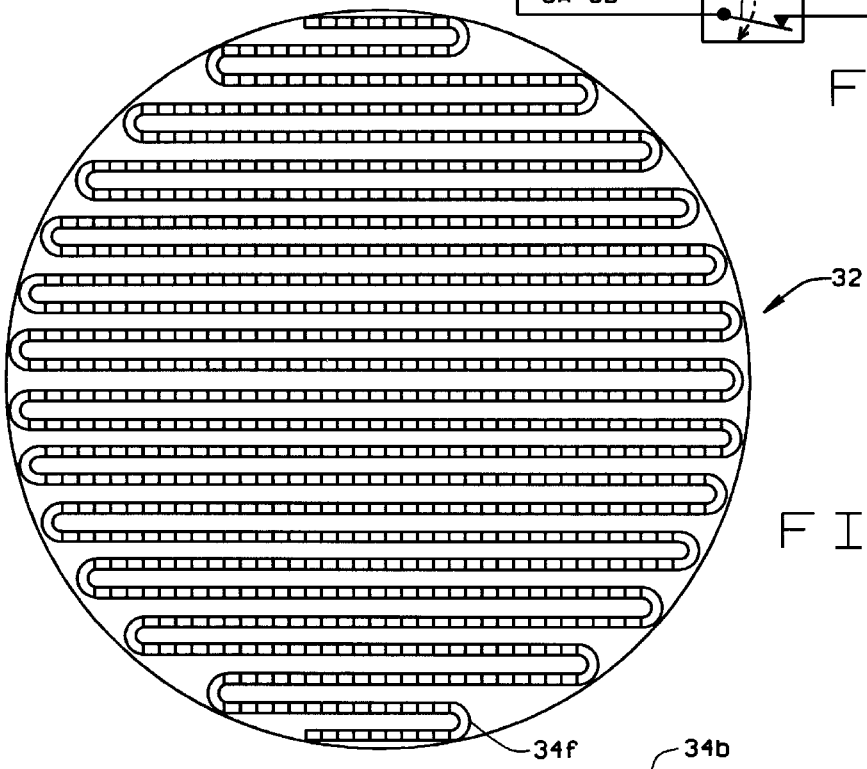
FIGS. 4A and 4B are respective elevational views of the ribbon after it has been corrugated.
Figure 4A:
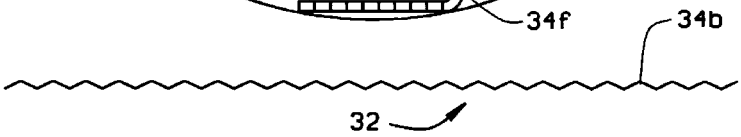
Figure 5A:
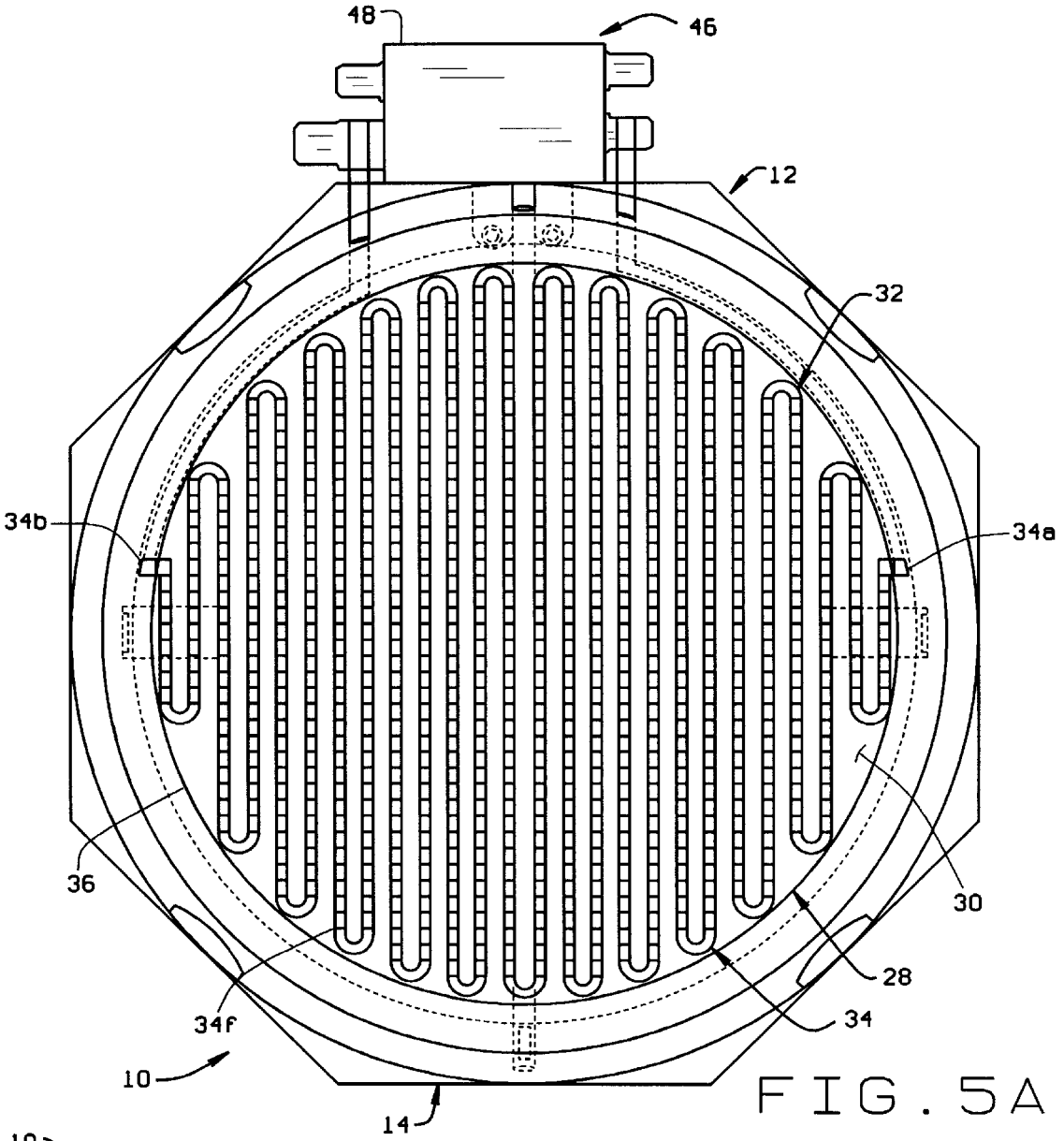
FIGS. 5A and 5B are respective plan and elevational views of a heating unit with the heating element installed.

Next, apparatus 10 includes a liner means 28 installed in pan 14. In FIG. 5A, the liner means is shown to include a round or pancake-shaped insulation material 30 having a thickness corresponding to approximately one-half the height of the sidewall of the pan. An electrical heating means 32 is installed on the liner means. Means 32 comprises a strip 34 of an electrically resistant foil material to which an electrical current is supplied. The strip of material generates heat which is radiated directly at the cooking surface when current is supplied to the strip. In FIG. 3, strip 34 is shown as being an initially smooth strip which is processed to form a corrugation as shown in FIGS. 4A and 4B. Or, the strip can be a corrugated strip initially. Regardless, strip 34 is 0.074" (0.19 cm.) wide, 0.002" thick (0.05 mm.), and has a resistivity of 1.39 $\Omega^*mm^2/m$, for example. In its corrugated form of FIG. 4A, the height of the strip is, form example, 0.052" (0.13 cm.) high. Each section of corrugation is 0.125" (0.32 cm) long. And, the adjoining sections of the strip are at 135° angles to each other.

Strip 34 is placed on a top surface 36 of liner 30. To provide a maximum length of radiating material, the heating element is laid upon the liner surface in a sinuous pattern in which the strip has a series of longitudinal sections or reaches which gradually increase from one side of the pan to a maximum at the center of the pan, and then gradually become shorter as the opposite side of the pan is reached. The strip is placed upon the top surface of the liner face up. Because the face 34*f* of the strip is relatively wide compared to the strip's thickness, and since face 34*f* directly faces the underside of the cooking surface to be heated, the resultant heat transfer between the heating unit and cook top is maximized. If the upper surface of the liner is a heat reflective surface, it will further increase the heat transfer between the heating element and the cook top.

Figure 5B:
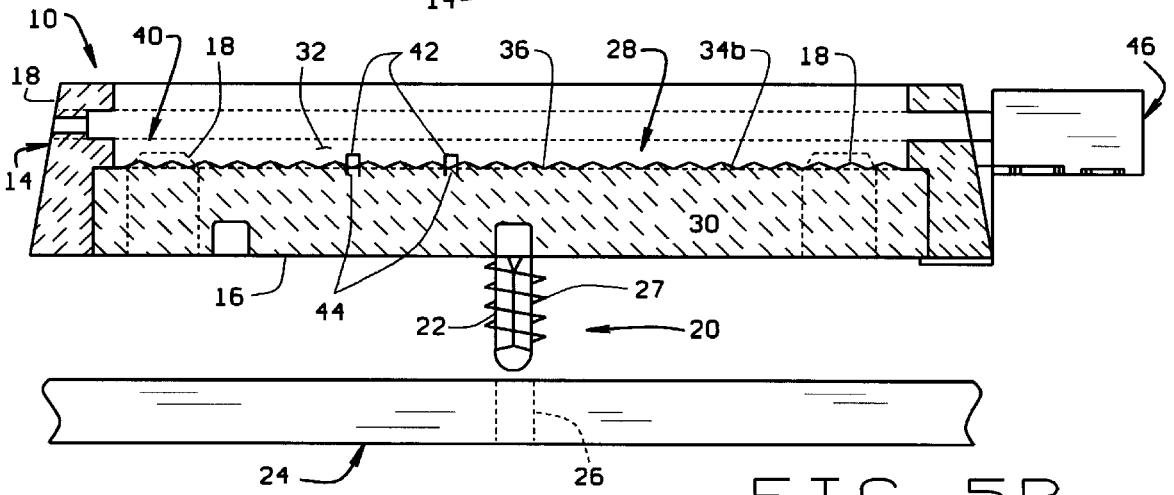

To maintain strip 34 in its position relative to the heating unit, apparatus 10 includes a means 40 for securing the heating element to the liner means. Means 40 includes a plurality of staples 42 (see FIG. 6) having a width slightly greater than that of the strip, and legs 44 whose length is approximately 0.394" (10 mm.), for example. The ends of the legs are tapered into points to facilitate insertion of the staples into the liner. The staples are used at the end of each reach of strip, where the strip is curved back onto itself. The staples do not press the strip against the upper surface of the liner when installed. Rather, a space is left between the staple and strip as shown in FIG. 5B. Other securing means besides staples could be used to accomplish the same result. However, when the ends of the staples are driven into liner 30, a segment of the strip is firmly captured between the staple and the liner. And, although the staple allows a flexing movement of the strip when a current is applied to the strip to generate heat, the strip is prevented from becoming distorted, even after repeated heating cycles.

Figure 7:
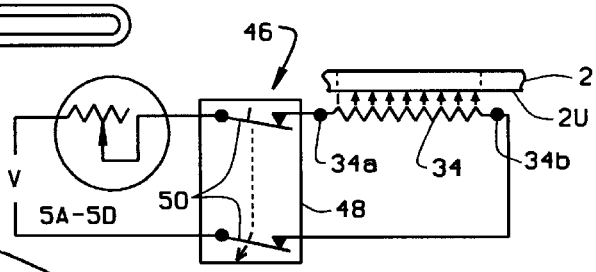
FIG. 7 is a simplified schematic diagram of the heating unit.

Next, apparatus 10 includes a temperature sensitive means 46 for controlling current flow to the heating element. In the schematic of FIG. 7, the current path to the heating element from temperature control knob 5, is through means 46. In FIG. 5A, the respective ends 34*a*, 34*b* of strip 34 are connected to a thermal limiter 48 which comprises the temperature sensitive means. Limiter 48 includes a thermally responsive switch 50, which, when closed, maintains the current path through the strip. However, the switch is responsive to the temperature of the cooking surface exceeding a predetermined temperature to open its contacts and break the current path through one leg of the heating element.

A particular advantage of the above described apparatus is that strip 34 can be much thinner than conventional strip heating elements. This is important because it allows heating unit 10 to be placed substantially closer to the cooking top than conventional heating units using resistance strip can be placed. This further increases the heat transfer efficiency of the apparatus. Also, the layout pattern of the heating element does not have to be the sinuous pattern shown in the accompanying drawings. Other patterns, if desired, can also be used.

Figure 8A:
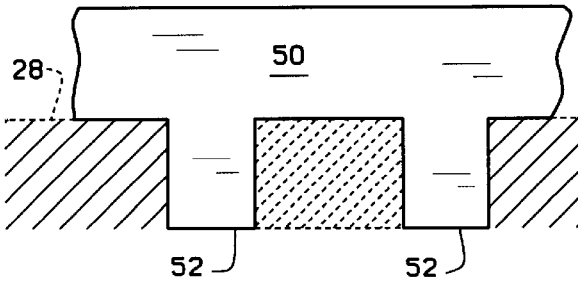
FIGS. 8A and 8B are partial elevational views of an alternate embodiment of the invention for securing a strip heating element in a heating unit, the respective embodiments having tabs of different lengths.
Figure 8B:
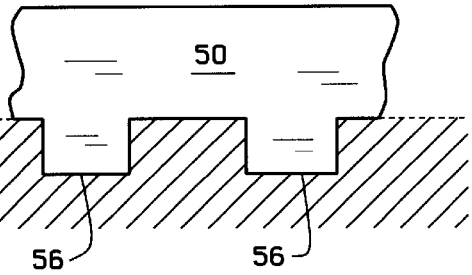

Referring now to FIGS. 8A–10, there are shown alternate embodiments of strip heating elements. These elements have different constructions by which the elements are secured to a liner means 28 rather than by using staples 42. In FIGS. 8A and 8B, a strip heater element 50 includes a plurality of spaced tabs 52. The tabs are pushed into the liner material 28. The tabs are formed by feeding the strip heater element 50 through a cutting machine, for example, so a section 54, indicated by the dashed lines, of the heater element material is cut away. Thus, the heater element and tabs are integrally formed. In FIG. 8B, the heater element 50 has integrally formed tabs 56 for securing the heater element to the liner. Now, the tabs are of a different length than the tabs 52.

Figure 9A:
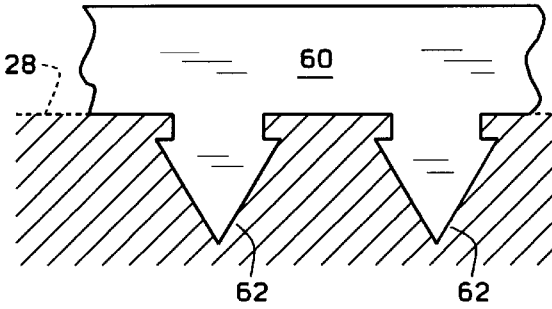
FIGS. 9A and 9B are also partial elevational views of additional alternate embodiments in which the heating elements have pointed tabs for securing the heating element; and, FIG. 10 is an end view of another embodiment of the heating element.
Figure 9B:
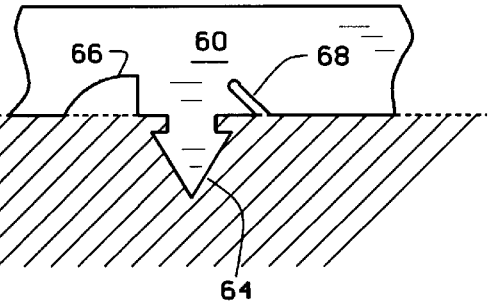

In FIGS. 9A and 9B, a heater element 60 is shown with integrally formed tabs 62 and 64 respectively. "In this embodiment, the heater element is directed through a press or the like so section 74 is a narrower section than section 72." Further, the heater element 60 of FIG. 9B also has a cutout on either side of the tab 64. One cutout 66 is shown as being a louver shape, and the other cutout 68 a slot. In each instance, the cutout is formed adjacent the tab. And, in each instance, the cutout is an open ended cutout which opens into the body of the heating element from a side of the heating element; i.e., from the bottom or base of the heating portion of the heater element.

Figure 10:
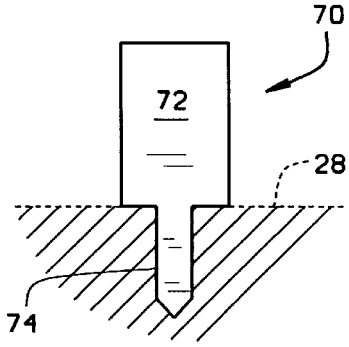

Finally, in FIG. 10, a heater element 70 is shown as being an integrally formed unit having a heating section 72, and a base section 74 which fits into the liner material to secure the strip heater in place. In this embodiment, the heater element is directed through a press or the like so section 74 is a narrow section than section 72. Again, although not shown, the section 72 of the heater element may additionally be formed to have the tabs 52, 54, 62, or 64, as well as the cutouts 66 or 68.

The reason for forming a strip heater element in this way is so when current flows through the heating element, the greatest amount of current flows through the portion of the heating element above the liner. This provides for the most efficient heating by the heating element. When the entire heating element is positioned on top of the liner, as shown in FIG. 5B, the heat generated by the heating element will be directed upwardly at the cooking surface. When portions of the heater element are used to secure the heater element in place, it is important to minimize current flow through the portion of the element set in the liner material, with the understanding there must be a sufficient number of tabs to adequately hold the heater element in place despite repeated expansions and contractions of the heater material. By minimizing the flow area through these portions of the heater element, the resistance to current flow in these areas is increased due to $R=\rho l/A$ where R is resistance, $\rho$ is resistivity of the material, l is the length, and A is area. The smaller the area, the greater the resistance, and the less the current flow through that portion.

What has been described is a radiant heating unit for use in cooking tops for stoves. The heating unit is mounted beneath the cooking top to radiate heat at a defined area of the cooking top; this area representing a cooking surface on which utensils are set to cook food. The heating unit has a corrugated foil, radiant heating element which is mounted on a liner of the heating unit, in one of a number of defined patterns, and anchored in place on the liner so as to not work itself loose during repeated operating cycles of the unit. Unlike prior art installations, the heating element of the present invention efficiently radiates heat onto the cooking surface rather than heating the cooking surface indirectly by the heat being scattered or reflected onto it. The heating element is readily usable in existing heating units and provides an efficient, reliable, low cost, heating source for heating the cooking surface. The strip heater can be placed wholly on top of a liner material and secured to the liner with staples placed at desired intervals. Or, the strip heater can have integrally formed tabs of different shapes and sizes which are used to secure the heating element in place.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A radiant heating unit for use on a stove, the heating unit being mounted beneath a glasstop type cooking surface for radiating heat at the surface to heat the surface for cooking food thereon, the unit comprising:

pan means installed adjacent an underside of the cooking surface;

liner means installed in the pan means, the liner means being formed of an insulation material;

an electrical heating element supported atop the liner means and being formed of a strip of an electrically resistant material to which an electrical current is supplied, the strip being a corrugated strip of material laid upon an upper surface of the liner in a predetermined pattern for heat generated by the heating element to be radiated directly at the cooking surface;

means securing the heating element to said liner means and including a plurality of spaced tabs integrally formed with said heating element, said tabs being inserted in said liner means to secure said heating element in place, each of said tabs having a tapered, pointed end for ease of installing said heating element in said liner means and a broad, base end opposite said tapered pointed end, said heating element having an extension connecting the broad, base end of said tab to said heating element; and, temperature sensitive means for controlling current flow to the heating element.

2. The heating unit of claim 1 wherein the heating element is laid upon the liner surface in a sinuous pattern.

3. The heating unit of claim 2 wherein the securing means comprises a plurality of staples whose ends are driven into the liner with a segment of the strip captured between the staple and the liner, the staple allowing flexing of the strip when a current is applied to the strip to generate heat, but preventing the strip from becoming distorted, even after repeated heating cycles.

4. The heating unit of claim 2 wherein the strip has a surface area sufficiently large so when the strip is laid upon the upper surface of the liner a maximum surface area of the strip directly faces the underside of the cooking surface to maximize the amount of heat radiated at the cooking surface.

5. The heating unit of claim 1 wherein the temperature sensitive means includes a thermal limiter responsive to the temperature of the cooking surface exceeding a predetermined temperature to open the current path through the heating element.

6. The heating element of claim 1 wherein said heating element has cutouts formed therein adjacent the tabs, said cutouts extending into said heating element from an edge thereof, and said cutouts being spaced to either side of a tab so as to not be in registry with any portion of the tab to which said cutouts are adjacent.

7. The heating element of claim 6 wherein said cutouts are open ended cutouts which extend into the body of said heating element from a side of the heating element adjacent a tab.

8. The heating element of claim 1 having a first, thicker section and a second, thinner section, said thicker section disposed substantially above said liner means and said thinner section disposed substantially within said liner means, the resistance in the thinner section being greater that in the thicker section for current flow through the thicker section being greater than that through the thinner section.

9. In an electrical powered, radiant heating unit mounted beneath a cooking surface of a stove for radiating heat at the surface to heat the surface, the unit including a pan mounted beneath the cooking surface, and a liner formed of an insulation material installed in the pan, the improvement comprising:

an electrical heating element installed on a surface of the liner adjacent the cooking surface, said heating element being formed from a strip of an electrically resistant material to which an electrical current is supplied, the strip being laid upon said surface of the liner in a predetermined pattern for heat generated by the heating element to be radiated directly at the cooking surface;

tabs integrally formed with the heating element for securing the heating element to said liner, each of said tabs having a tapered, pointed end for ease of installing said heating element in said liner means and a broad, base end opposite said tapered pointed end, said heating element having an extension connecting the broad, base end of said tab to said heating element; and temperature sensitive means for controlling current flow to the heating element.

10. The heating element of claim 9 wherein said heating element has cutouts formed therein adjacent the tabs, said cutouts extending into said heating element from an edge thereof, and said cutouts being spaced to either side of a tab so as to not be in registry with any portion of the tab to which said cutouts are adjacent.

11. The heating element of claim 10 wherein said cutouts are open ended cutouts which extend into the body of said heating element from a side of the heating element adjacent a tab.

* * * * *